US006821074B2

(12) United States Patent
Schreiber et al.

(10) Patent No.: US 6,821,074 B2
(45) Date of Patent: Nov. 23, 2004

(54) AUTOMATED CONTAINER LOADER FOR REFUSE VEHICLE

(75) Inventors: Lynn Donald Schreiber, Medicine Hat (CA); Simon Huang, Medicine Hat (CA)

(73) Assignee: Wittke Inc., Medicine Hat (CA)

( * ) Notice: Subject to any disclaimer, the term of this patent is extended or adjusted under 35 U.S.C. 154(b) by 138 days.

(21) Appl. No.: 10/067,874

(22) Filed: Feb. 8, 2002

(65) Prior Publication Data

US 2003/0152447 A1 Aug. 14, 2003

(51) Int. Cl.[7] ..... B66F 9/18; B66C 1/44

(52) U.S. Cl. ..... 414/408; 414/555; 294/106; 294/119.2

(58) Field of Search ..... 414/406, 408, 414/555, 733, 739; 294/106, 86.4, 113, 119.2, 88

(56) References Cited

U.S. PATENT DOCUMENTS

| | | | | | |
|---|---|---|---|---|---|
| 2,959,444 | A | * | 11/1960 | Callender | 294/86.4 |
| 3,759,564 | A | * | 9/1973 | Seaberg | 294/106 |
| 4,461,608 | A | * | 7/1984 | Boda | 414/408 |
| 4,708,570 | A | * | 11/1987 | Smith et al. | 414/408 |
| 5,020,844 | A | * | 6/1991 | Pickrell | 294/86.4 |
| 5,026,104 | A | * | 6/1991 | Pickrell | 294/86.4 |
| 5,092,731 | A | | 3/1992 | Jones et al. | |
| 5,209,537 | A | * | 5/1993 | Smith et al. | 294/106 |
| 5,391,039 | A | * | 2/1995 | Holtom | 414/408 |
| 5,398,983 | A | * | 3/1995 | Ahrens | 294/106 |
| 5,547,332 | A | * | 8/1996 | Smith et al. | 414/408 |
| 5,562,386 | A | | 10/1996 | Browning | |
| 5,720,589 | A | * | 2/1998 | Christenson et al. | 414/408 |
| 5,759,008 | A | * | 6/1998 | Smith et al. | 414/555 |
| 5,769,592 | A | | 6/1998 | Christenson | |
| 5,833,429 | A | | 11/1998 | McNeilus et al. | |
| 5,846,044 | A | | 12/1998 | Smith et al. | |
| 5,931,628 | A | | 8/1999 | Christenson | |
| 6,004,092 | A | | 12/1999 | Johnson et al. | |
| 6,012,895 | A | | 1/2000 | Smith et al. | |
| 6,139,244 | A | * | 10/2000 | VanRaden | 414/408 |

* cited by examiner

*Primary Examiner*—Paul T. Chin
(74) *Attorney, Agent, or Firm*—Anissimoff & Assoc.; Hans Koenig

(57) ABSTRACT

An automated container loader for mounting to the side of a vehicle adapted for collecting the contents of curbside residential waste containers. The vehicle has a vehicle body longitudinally attached to the vehicle chassis. The automated container loader is attached to the vehicle chassis by a slide and positioned adjacent the side of the vehicle body. The container loader is equipped with a lift arm having a gripping element having a gripper housing having an opposing pair of gripping jaws. The gripping jaws are pivotally attached to the gripper housing on opposite sides to their respective arms, thereby creating a cross-pivoting arrangement. The distance between the free ends of the gripping jaws is thereby reduced when in the open position. The cross-pivoting arrangement further allows the container loader to have a thin overall width, accomplished through use of a non-folding single-section gripping jaw.

14 Claims, 7 Drawing Sheets

AUTOMATED CONTAINER LOADER FOR REFUSE VEHICLE

BACKGROUND OF THE INVENTION

1. Field of the Invention

The invention relates to refuse vehicles used in residential curbside waste collection. More specifically, the invention relates to an automated container loader for mounting to the side of a refuse vehicle.

2. Description of the Prior Art

In the waste collection industry, it is well known to use a vehicle equipped with a specialized body to collect the contents of curbside residential waste containers and compact the contents prior to disposal. The vehicle typically includes a cab containing the controls to operate the vehicle and a chassis having a front and rear set of wheels. The vehicle body is mounted on top of the chassis and has at its front end a receiving hopper for collection of the waste and at its rear end a storage compartment for compaction of the collected waste.

In order to load the vehicle, the curbside residential waste containers are, for example, manually lifted and downwardly tipped into an opening through the side of the receiving hopper. In order to facilitate this activity, the receiving hopper is often at a lower elevation with respect to the storage compartment. This is commonly referred to in the waste collection industry as a "drop-deck" vehicle body.

An automated container loader may be used to eliminate the need for a drop-deck vehicle body. These types of devices typically consist of a mechanized lift arm having an attached gripping element with a pair of gripping jaws. The device is capable of grasping, lifting, and emptying the residential waste container over the side of the receiving hopper and returning the emptied container to the curbside.

It is desirable that a waste collection vehicle be capable of carrying a large load of waste while remaining stable during transit. To accomplish this, it is important that the vehicle body be positioned as far forward on the vehicle chassis as possible. This allows the center of gravity of the vehicle to move longitudinally forward, distributing some of the weight to the front set of wheels, increasing the weight carrying capacity of the vehicle and improving the vehicle's road stability.

Ideally, this means that the vehicle body abuts or is at least in close proximity to the vehicle cab. In order that the vehicle body may be mounted immediately rearward of the vehicle cab, the automated container loader is preferably located directly adjacent the side of the receiving hopper and attached to the vehicle chassis. Furthermore, the automated container loader is desirably located at substantially the longitudinal midpoint of the receiving hopper. This allows a simple lift arm to be used that pivots only in the vertical plane, without any need for movement along the length of the vehicle.

When not in use, the gripping jaws are normally stowed in the open position. To prevent interference with the vehicle cab, the distance between the free ends of the gripping jaws, or the longitudinal span of the gripping jaws, must be reduced. It is known in the prior art to use multi-section folding jaws to accomplish this reduction in distance between the free ends of the open gripping jaws. These types of jaws are complicated and expensive to construct. They may require additional hydraulic cylinders to operate the gripping element. Moreover, folding of the jaws increases the overall thickness of the container loader when stowed, causing it to protrude outwardly from the width of the vehicle.

The width of road traveling vehicles is regulated in most jurisdictions; accordingly, the container loader cannot protrude past the regulated width when in the stowed position. To comply with these regulations, vehicles equipped with side mounted container loaders having multi-section gripping jaws often also have recessed or narrow receiving hoppers to accommodate road width regulations. A disadvantage of a narrow receiving hopper is that the receiving hopper packing blade cannot travel the full length of the vehicle body to function as an ejector for stored waste.

An alternative approach is to provide a side mounted container loader having a thin overall width so as not to protrude past the regulated road width of the vehicle. This allows the vehicle to have a regular width receiving hopper, thereby enabling use of the receiving hopper packing blade as an ejector. In order to have a thin overall width, multi-section folding gripping jaws cannot be used and an alternative approach must be devised.

The present invention seeks to reduce the distance between the free ends of the gripping jaws while overcoming the aforementioned disadvantages of folding jaws, such as mechanical complexity and excessive width, thereby allowing the receiving hopper to have the same width as the storage compartment.

SUMMARY OF THE INVENTION

According to an aspect of the invention, there is provided an automated container loader for a refuse vehicle having a lift arm and opposing first and second jaw means for gripping and releasing a refuse container. Each of the opposing jaw means has a first free end and second opposite end pivotally attached to the end of the lift arm at, respectively, a first and second pivot location on the lift arm and each jaw means is hydraulically operable to open and close. The improvement comprises a cross-pivot arrangement for each jaw means wherein the first and second pivot locations are transposed for each of the jaws to thereby reduce the ordinary distance between the free ends of the jaws when in the open position. The jaws are adapted to open and close without coming into contact with one another.

According to another aspect of the invention, each of the jaw means includes a flexible belt having a first end attached to the free end of the jaw means and a second end attached to the end of the lift arm. The belt is located inward of each jaw means and tensioned between the ends to engage the refuse container.

According to yet another aspect of the invention, the first jaw means comprises a single jaw member and a flexible belt and the second jaw means comprises a pair of substantially parallel jaw members and flexible belts in spaced apart vertical relation to each other.

According to yet another aspect of the invention, each of the jaw members are vertically aligned with reference to each other such that the free ends of the jaw members may pass between one another to intersect.

According to yet another aspect of the invention, each flexible belt is engaged against the refuse container to thereby secure the refuse container between the belts.

According to yet another aspect of the invention, the automated container loader comprises a vertical frame element having upper and lower ends and a hydraulic lift cylinder having fixed and extendable ends. The fixed end of the lift cylinder is pivotally attached to the lower end of the vertical frame element and the extendable end is pivotally attached to the lift arm. The lift arm has first and second ends, the first end pivotally attached to the upper end of the vertical frame element, the second end pivotally attached to each jaw means. The hydraulic lift cylinder is operable to vertically pivot the lift arm, thereby changing the elevation of the refuse container.

According to yet another aspect of the invention, the automated container loader comprises a tipping link member having first and second ends, the first end pivotally attached to the upper end of the vertical frame member, the second end pivotally attached to the jaw means. The tipping link member is operable to downwardly pivot the refuse container in response to vertical pivoting of the lift arm.

According to yet another aspect of the invention, there is provided an automated container loader for a refuse vehicle having a lift arm and opposing first and second jaw members for gripping a refuse container, each opposing jaw member having a free end and an attached end. The attached end of the first jaw member is pivotally attached to the end of the lift arm at a first pivot location and the attached end of the second jaw member is pivotally attached to the end of the lift arm at a second pivot location. Each jaw member is hydraulically operable to close and open in order to grip and release, respectively, the refuse container. The improvement comprises a cross-pivot arrangement for each jaw member wherein the attached end of the first jaw member is pivotally attached to the end of the lift arm at the second pivot location and the attached end of the second jaw member is pivotally attached to the end of the lift arm at the first pivot location to thereby reduce the ordinary distance between the free ends of the jaw members when in the open position. The jaw members are adapted to open and close without coming into contact with one another.

Further features of the invention will be described or will become apparent in the course of the following detailed description.

BRIEF DESCRIPTION OF THE DRAWINGS

In order that the invention may be more clearly understood, a preferred embodiment thereof will now be described in detail by way of example, with reference to the accompanying drawings, in which.

PREFERRED EMBODIMENT

Figure 1:
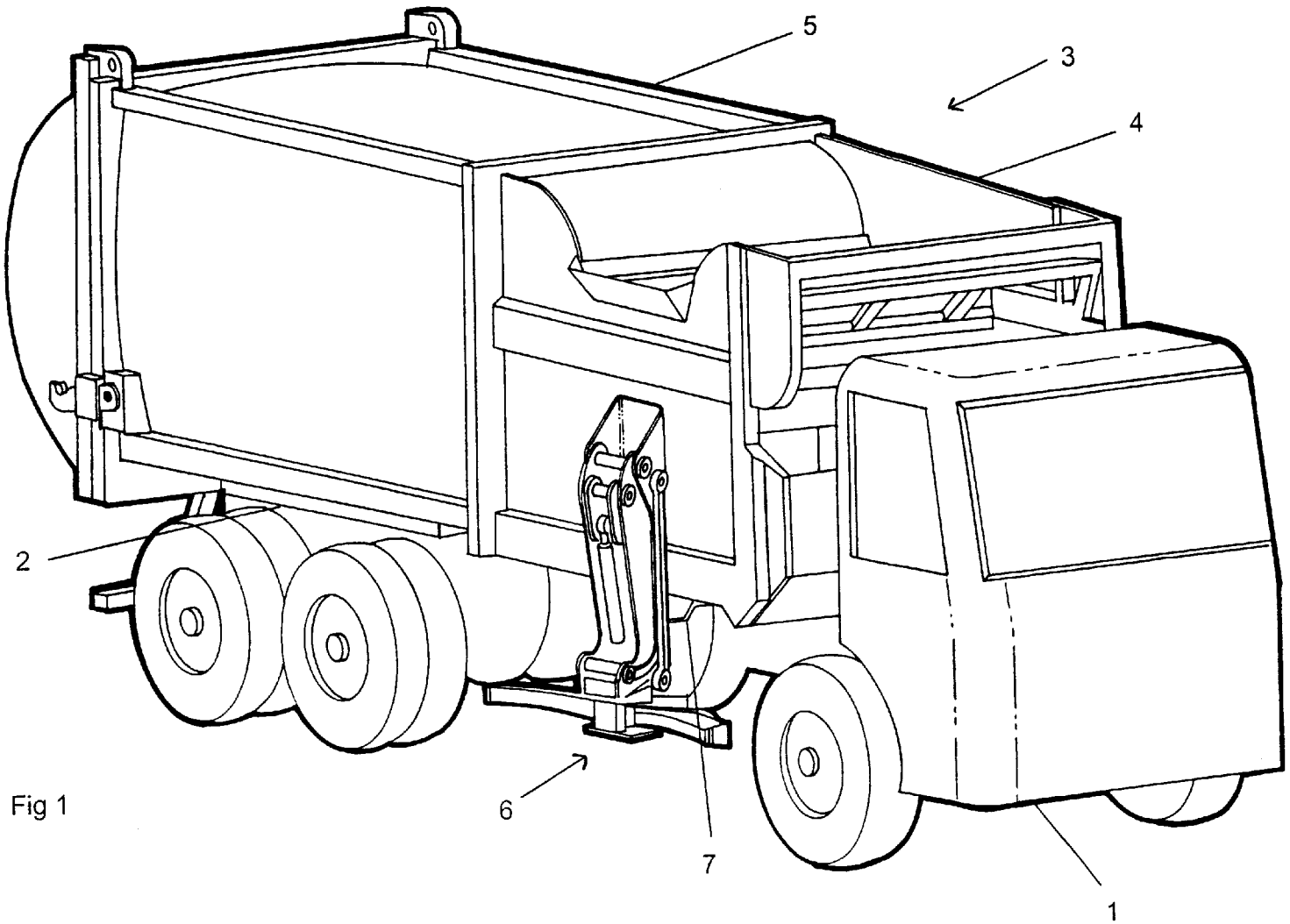
FIG. 1 is a perspective view of the waste collection vehicle of the present invention, equipped with an automated container loader.

With reference to FIG. 1, the waste collection vehicle includes a vehicle cab (1) and chassis (2) having a vehicle body (3) mounted thereto. The vehicle body (3) includes a forward receiving hopper (4) for collection of waste materials from curbside waste containers and a rearward storage compartment (5) for compacted waste. An automated container loader (6) for securing, lifting and tipping curbside waste containers is located adjacent to the side of the receiving hopper (4). The container loader is aligned with and mounted on a telescoping slide (7) attached to the chassis (2), beneath the vehicle body (3), at substantially the longitudinal midpoint of the receiving hopper (4). The slide (7) may be extended to allow the container loader (6) to move away from the side of the vehicle into a position adjacent to a curbside waste container.

Figure 2:
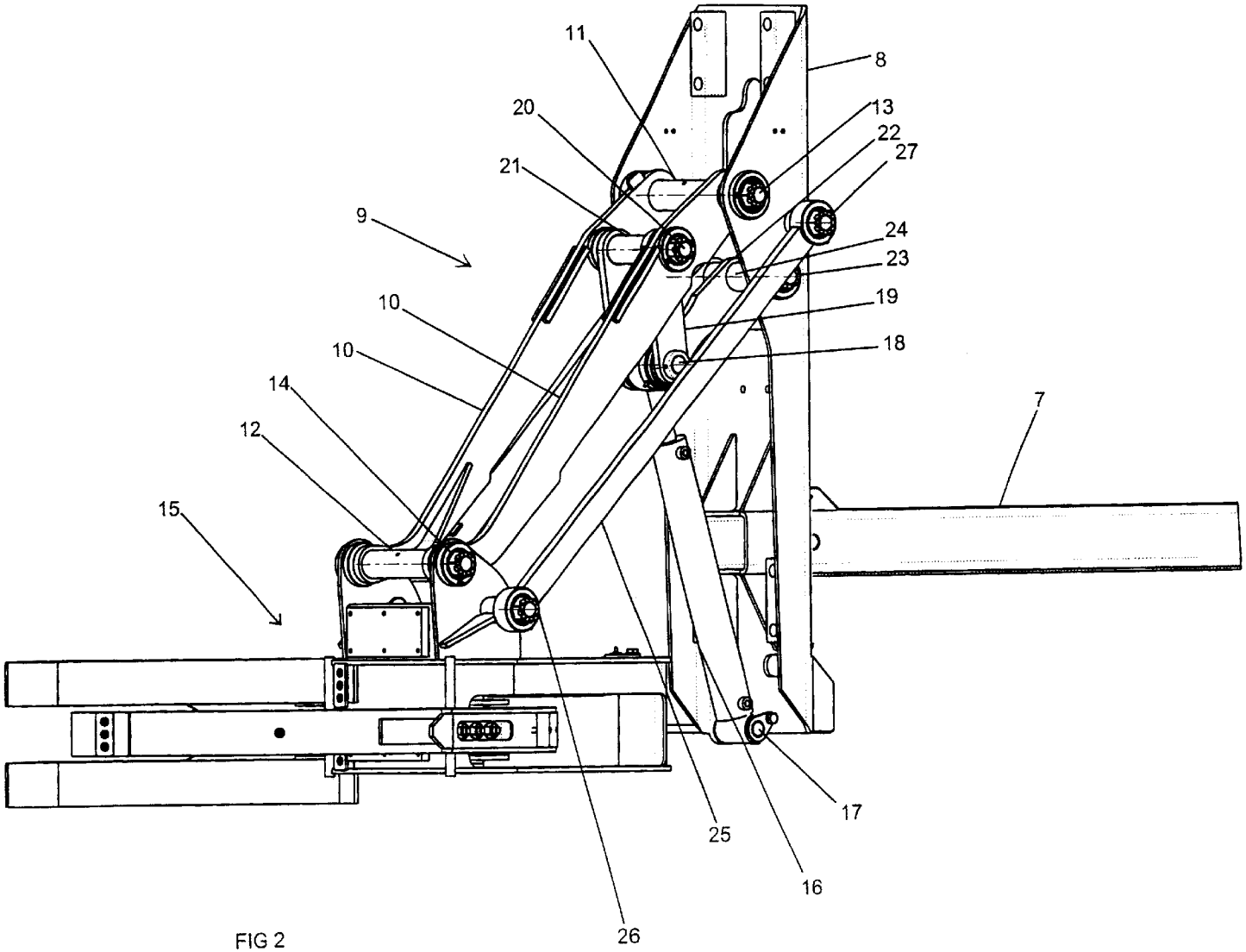
FIG. 2 is a perspective view of the automated container loader.

With reference to FIG. 2, the automated container loader (6) will be more completely described. A vertical upright frame member (8) is fixedly and perpendicularly attached to the telescoping slide (7). A lift arm is generally shown (9) comprising a pair of lift arm members (10) connected at each end by a horizontal shaft (11, 12), is pivotally attached at its upper end (13) to the upright frame member (8) by means of an upper shaft (11) passing therethrough and at its lower end (14) to a gripping element (15) by means of a lower shaft (12) in a similar manner. The gripping element (15) is generally shown and forms part of the lift arm (9); the gripping element will hereinafter be more thoroughly described.

A lift cylinder (16) is pivotally connected at its lower end (17) to the upright frame member (8) and pivotally connected at its upper end (18) to a lift arm linkage (19) by means of a horizontal pin. The lift arm linkage (19) is pivotally connected (20) to the lift arm (9) by means of the horizontal shaft (21) passing therethrough. Extension of the lift cylinder (16) causes the lift arm (9) to pivot about the attachment point 13, raising the gripping element (15). An upright frame linkage (22) is pivotally attached to the lift cylinder (16) at 18 and pivotally attached at its opposite end (23) to the upright frame member (8) by means of the horizontal shaft (24) passing therethrough. The upright frame linkage (22) maintains a separation distance between 18 and the upright frame member (8), providing leverage to pivot the lift arm (9) to the vertical position.

A tipping link bar (25) is pivotally connected at one end (26) to the gripping element (15) and pivotally connected at the opposite end (27) to the upright frame member (8). A pair of tipping link bars may be used and may be connected by means of horizontal pins or a horizontal shaft as previously described. Both the length of the tipping link bar (25) and the position of the pivotal attachment points (26, 27) are chosen in order that the gripping element (15) pivots only slightly while the lift arm (9) is being raised. Raising the lift arm (9) towards the vertical position causes the gripping element (15) to tip towards the vehicle body.

Figure 3:
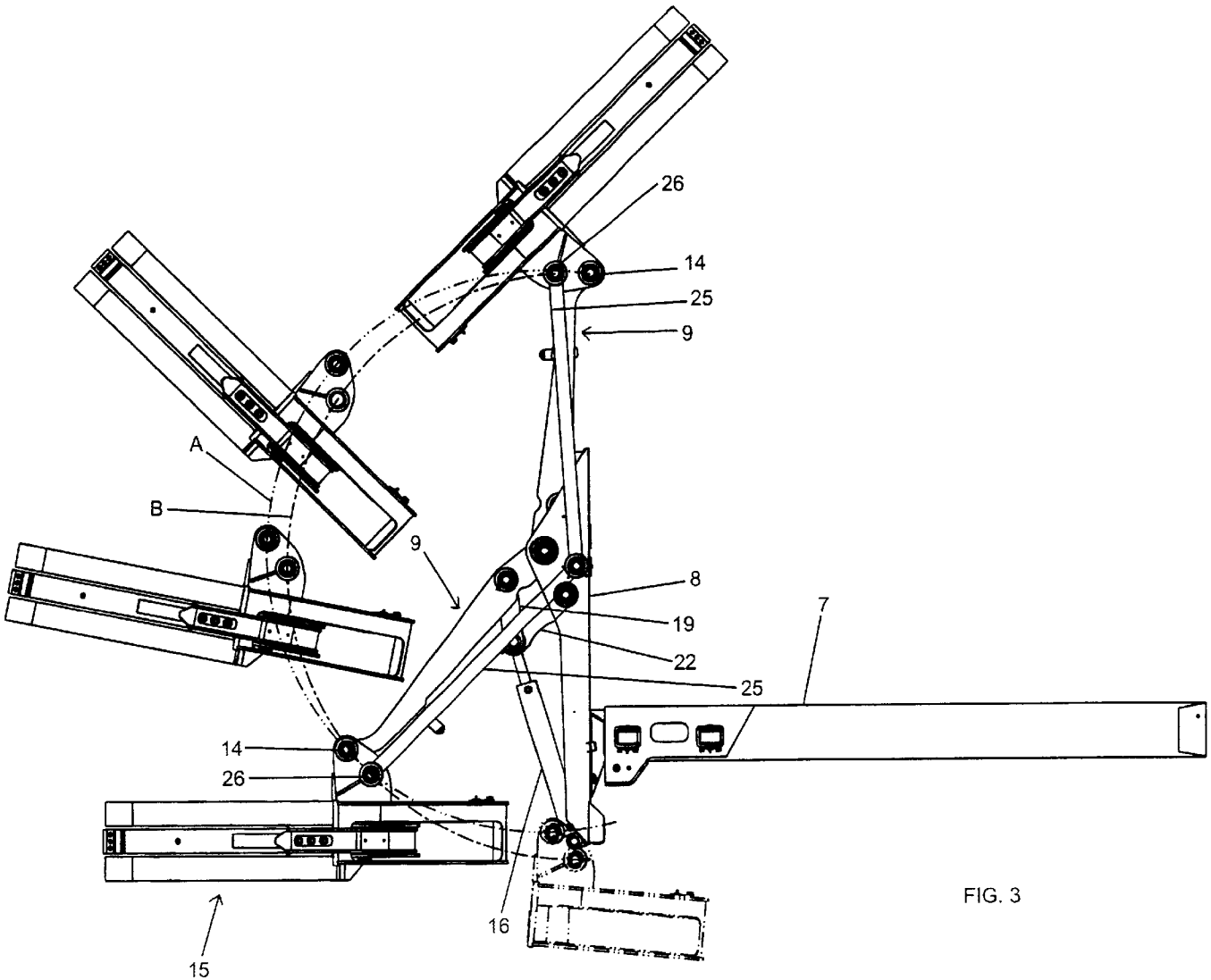
FIG. 3 is a side view of the automated container loader at various positions in the lifting cycle.

The pivoting of the gripping element (15) is illustrated with reference to FIG. 3. Arc A represents the path followed by connection point 14, while arc B represents the path followed by connection point 26. In the embodiment shown, the gripping element (15) tips only slightly as the lift arm is being raised. Further raising the lift arm (9) causes the tipping link bar (25) to pivot the gripping element (15) about the connection point 14, tipping the gripping element towards the vehicle body. This is illustrated by the two arcs A and B, which diverge when the lift arm (9) is being raised, preventing the gripping element (15) from tipping, then converge as the lift arm approaches the fully raised vertical position to tip the gripping element towards the receiving hopper (4). The tipping action causes the contents of a waste container held by the gripping element (15) to downwardly slide into the receiving hopper (4).

Figure 4:
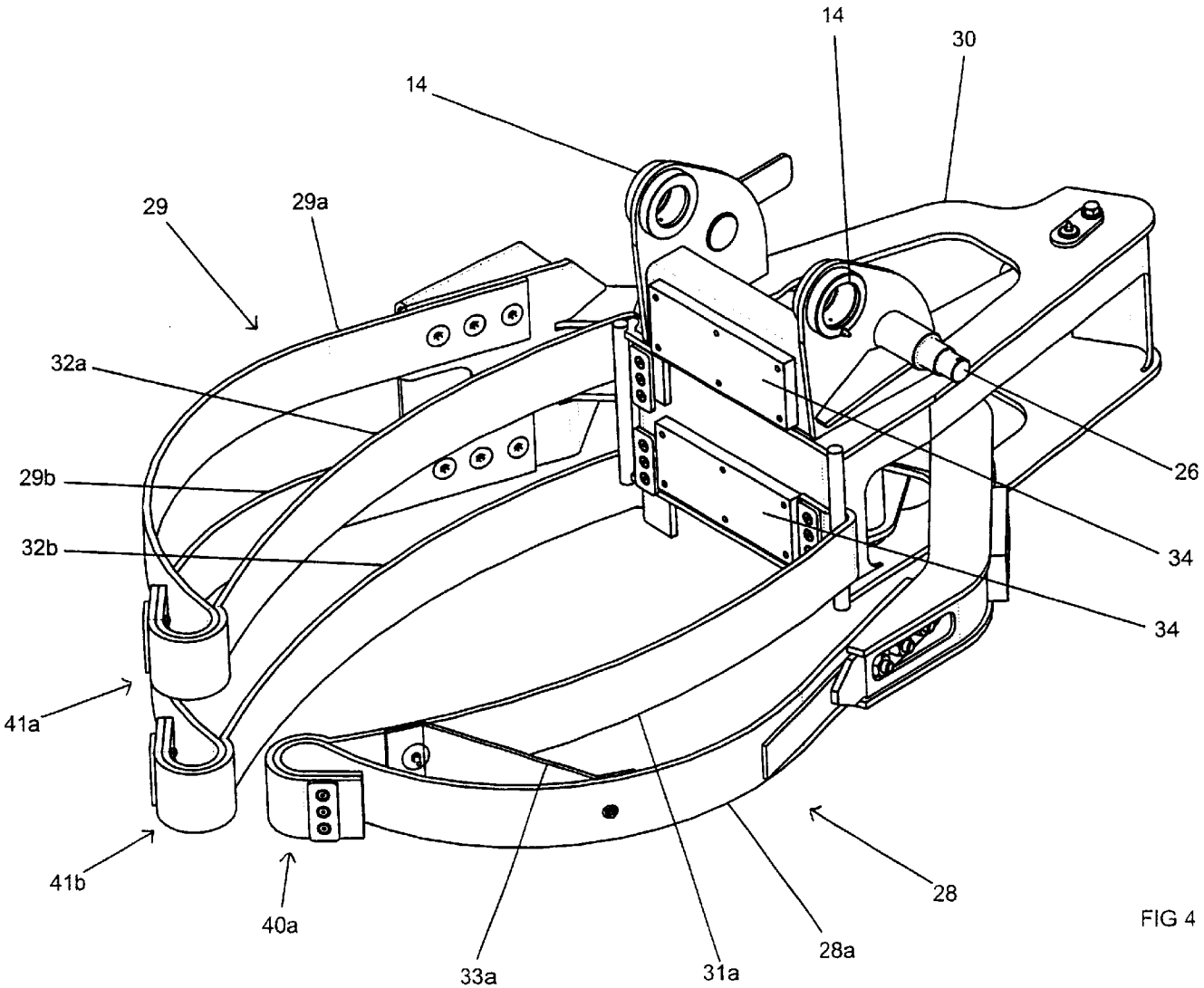
FIG. 4 is a perspective view of the gripping element of the automated container loader.

The gripping element (15) will be described with reference to FIG. 4. A single gripping jaw (28) and a dual gripping jaw (29) are generally shown and are each pivotally attached at one end to the gripper housing (30) in a manner that will hereinafter be more thoroughly described. The gripper housing (30) forms part of the end of the lift arm (9) and is provided as a point of attachment for the gripping jaws to the lift arm. The dual gripping jaw (29) includes a pair of substantially parallel jaw members (29*a*, 29*b*) vertically spaced apart so as to allow the single jaw member (28*a*) to freely pass therebetween upon operation of the gripping element. A long flexible belt (31*a*) is attached at one end to the inward side of the generally shown free end (40*a*) of the single jaw member (28*a*); a pair of belts (32*a*, 32*b*) is similarly attached to the dual gripping jaw members (29*a*, 29*b*), respectively. The long belts (31*a*, 32*a*, 32*b*) are also attached at their opposite end to the gripper housing (30). A short flexible belt (33*a*) connects the long belt (31*a*) and the single jaw member (28*a*). The purpose of the short belt (33*a*) is to prevent the long belt (31*a*) from sagging when the gripping jaws (28, 29) are in the open position. The dual jaw (29) may be similarly equipped with short belts (not shown). The jaw members (28*a*, 29*a*, 29*b*) are preferably made from a flexible steel material in order to maintain tension on the long belts (31*a*, 32*a*, 32*b*), especially when gripping a container. This results in the "bow" shape illustrated in FIG. 4. The gripper housing (30) may be equipped with pads (34) to protect the waste containers from damage and also to provide increased friction in order to securely retain a container when gripped.

Figure 5:
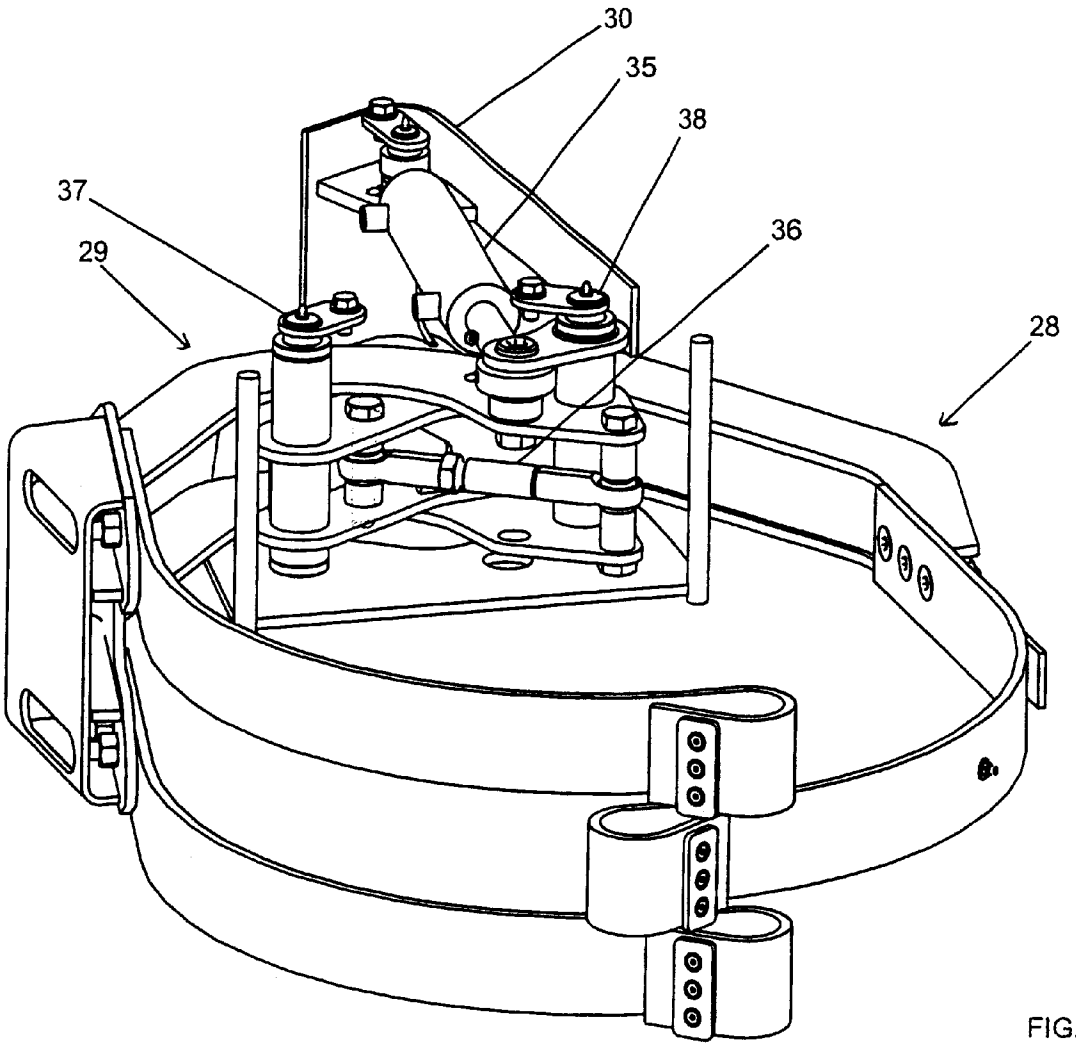
FIG. 5 is another perspective view of the gripping element of the automated container loader, with a portion of the gripper housing removed.

The action of the gripping element (15) will be described with reference to FIG. 5. Movement of the gripping jaws (28, 29) is effected by the hydraulic cylinder (35), which is pivotally connected in the embodiment shown to the dual jaw (29), but could alternatively be connected to the single jaw (28). A jaw linkage member (36) is pivotally attached by means of a vertical pin connection to both jaws (28, 29). Movement of the cylinder (35) thereby causes movement of both of the attached jaws (28, 29). The single jaw (28) is pivotally attached to the gripper housing (30) by a vertical pin connection (37); the dual jaw (29) is similarly attached (38). The pivot points (37, 38) are on opposite sides of the gripper housing (30) to their respective jaws (28, 29). This "cross-pivoting" arrangement of the jaws is achieved by transposing the pivot points of the jaws from their normal position, adjacent the same side of the housing as their respective jaw, and has the advantage of decreasing the distance between the free ends of the jaws when in the open position without the need for a folding multi-section gripping jaw, as is common in the prior art.

Figure 6:
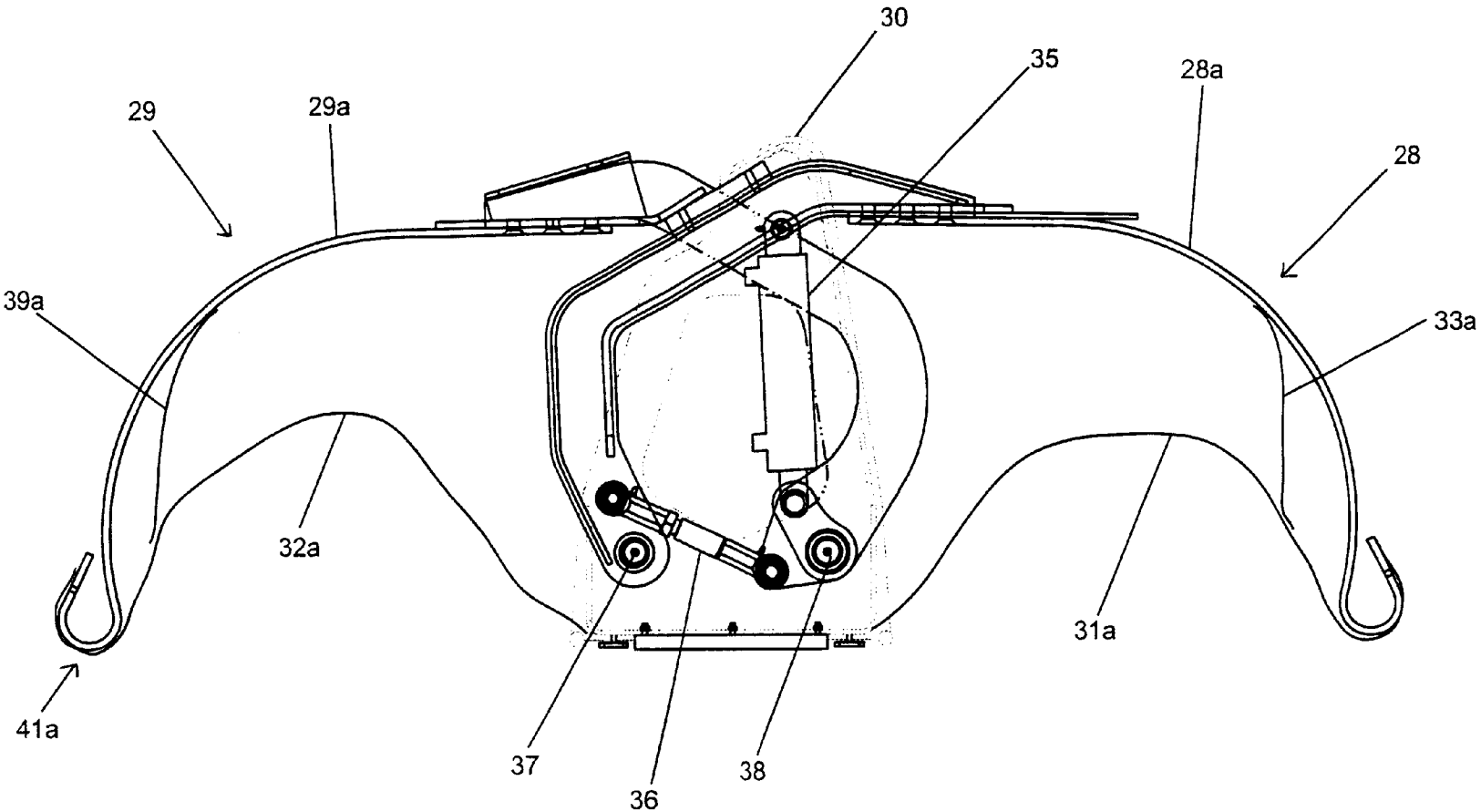
FIG. 6 is a top view of the gripping element of the automated container loader in the open position

The reduction in distance between the free ends of the jaws, generally 40*a* and 41*a* in top view, is shown with reference to FIG. 6. Since the long belts (31*a*, 32*a*) are attached at only one end to the gripping jaw members (28*a*, 29*a*) and at the other end to the gripper housing (30), the reduction in open longitudinal span of the jaws achieved by the cross-pivoting arrangement reduces the tension on the long belts (31*a*, 32*a*). This in turn allows the flexible gripping jaw members (28*a*, 29*a*) to return to a more linear orientation, reducing the curvature of the bow shape. The short belts (33*a*, 39*a*) additionally mitigate the tendency of the long belts (31*a*, 32*a*) to sag when the gripping jaws (28, 29) are in the open position.

Figure 7:
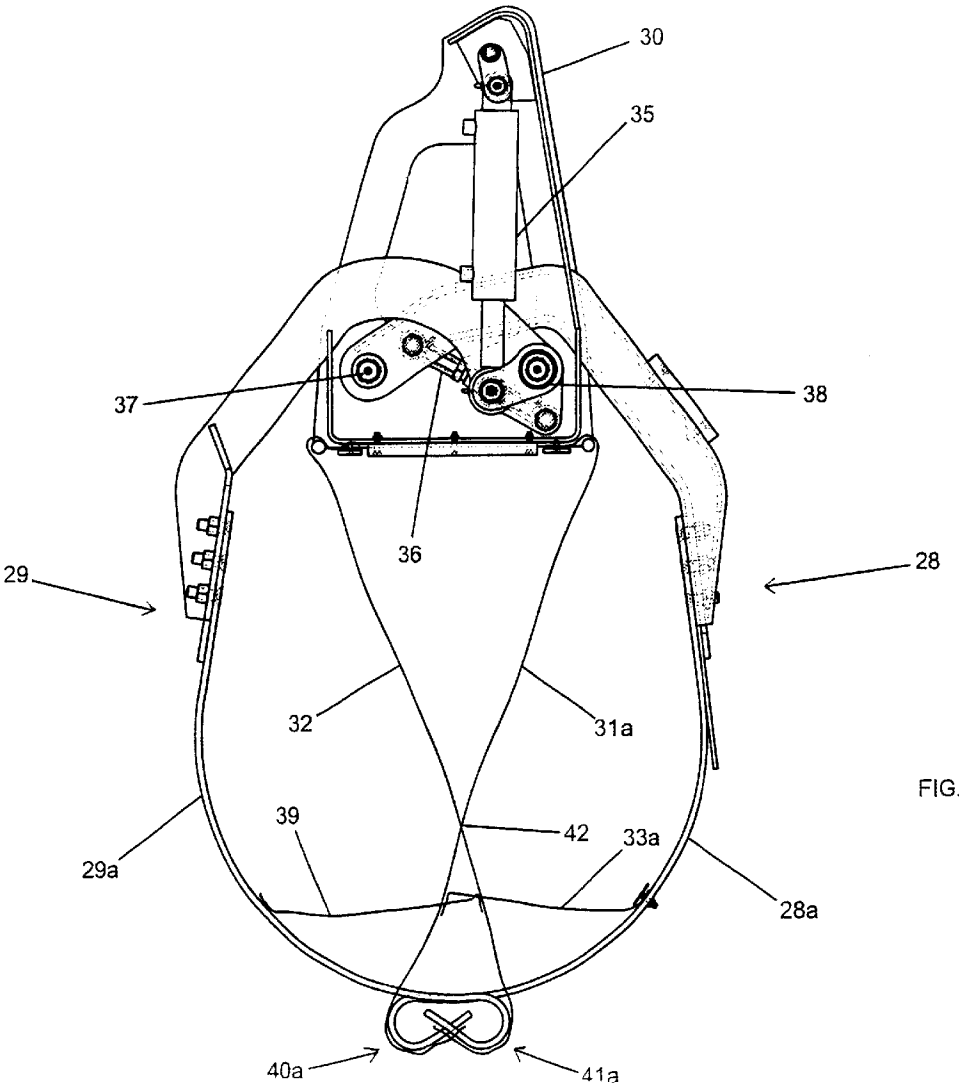
FIG. 7 is a top view of the gripping element of the automated container loader in the closed position.

FIG. 7 shows that when the gripping jaws (28, 29) are in the closed position, the free ends (40*a*, 41*a*) of the jaws overlap slightly. Since each of the long belts (31*a*, 32*a*) is connected at one end to the gripper housing (30), the belts overlap at a position (42) that is between the gripper housing and the free ends (40*a*, 41*a*) of the jaws. The overlap position (42) is a function of the distance between the attachment points of the long belts (31*a*, 32*a*) to the gripper housing (30) and the amount of overlap of the free ends (40*a*, 41*a*) of the jaws. Closing of the jaws (28, 29) around a container causes the long belts (31*a*, 32*a*) to frictionally engage the sides of the container and the curvature of the bow shape to increase. Containers of any size or shape may be securely gripped in this manner; however, it is desirable that the overlap position (42) be close to the gripper housing (30) in order to securely grip small containers, since increased belt area is thereby made available for engagement.

Due to the cross-pivoting arrangement of the gripping jaws (28, 29), a single section jaw may be used without the need for folding to reduce the distance between the free ends of the jaws. This allows the container loader to be longitudinally mounted near to the vehicle cab (1) without contact or other interference with the cab and provides the container loader with an overall thin profile with reference to the width of the vehicle. Since the container loader is attached adjacent the side of the receiving hopper (4), the thin width profile allows the receiving hopper to have the same width as the rest of the vehicle body, without any portion of the container loader extending past the regulated road width of the vehicle.

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having described the invention, what is claimed is:

1. An automated container loader for a refuse vehicle comprising a lift arm and hydraulically operable, opposing first and second jaw means for gripping a refuse container, the first jaw means having a free end and an attached end pivotally attached to the lift arm at a first pivot point and the second jaw means having a free end and an attached end pivotally attached to the lift arm at a second pivot point, the first pivot point being on an opposite side of the lift arm from the second pivot point, the first and second jaw means crossing each other, the first pivot point being located inward of the second jaw means and the second pivot point being located inward of the first jaw means, and, the free and attached ends of the first jaw means being on opposite sides of the lift arm when the jaw means are in an open position and the free and attached ends of the second jaw means being on opposite sides of the lift arm when the jaw means are in the open position.

2. The automated container loader according to claim 1, wherein the lift arm comprises a gripper housing and the first and second jaw means are pivotally attached to the gripper housing.

3. The automated container loader according to claim 2, wherein the first and second jaw means cross each other within the gripper housing.

4. The automated container loader according to claim 1, wherein each jaw means comprises a flexible belt having one end attached to the free end and another end attached to the lift arm, each belt located inward of the respective jaw means and tensioned to engage the refuse container.

5. The automated container loader according to claim 4, wherein the first jaw means comprises a single jaw member and a flexible belt and the second jaw means comprises a pair of substantially parallel jaw members and flexible belts in spaced apart vertical relation to each other to allow the single jaw member to pass between the parallel jaw members.

6. The automated container loader according to claim 5, wherein each of the flexible belts engages against the refuse container to thereby secure the refuse container between the belts when the first and second jaw means grip the refuse container.

7. The automated container loader according to claim 1, wherein the first and second jaw means are hydraulically operable by means of a hydraulic cylinder connected to the lift arm.

8. The automated container loader according to claim 7, wherein the hydraulic cylinder is pivotally connected to one of the jaw means and a jaw linkage member is pivotally attached to both of the jaw means, whereby movement of the hydraulic cylinder results in movement of both of the jaw means.

9. The automated container loader according to claim 1, further comprising a vertical frame element having an upper end and a lower end and a hydraulic lift cylinder having a fixed end and an extendable end, the fixed end of the hydraulic lift cylinder being pivotally attached to the lower end of the vertical frame element, the extendable end of the hydraulic lift cylinder being pivotally attached to the lift arm, and the lift arm being pivotally attached to the upper end of the vertical frame element, the hydraulic lift cylinder being operable to vertically pivot the lift arm to thereby change elevation of the refuse container.

10. The automated container loader according to claim 9, further comprising a tipping link member having a first end pivotally attached to the upper end of the vertical frame element and a second end pivotally attached to the jaw means, the tipping link member operable to downwardly pivot the refuse container in response to the vertical pivoting of the lift arm.

11. An automated container loader for a refuse vehicle comprising a lift arm, opposing first and second jaw means for gripping a refuse container and a hydraulic cylinder for hydraulically operating the first and second jaw means, the lift arm comprising a gripper housing, the first jaw means having a free end and an attached end pivotally attached to the gripper housing at a first pivot point and the second jaw means having a free end and an attached end pivotally attached to the gripper housing at a second pivot point, the first pivot point being on an opposite side of the gripper housing from the second pivot point, the first and second jaw means crossing each other within the gripper housing, the first pivot point being located inward of the second jaw means and the second pivot point being located inward of the first jaw means, the free and attached ends of the first jaw means being on opposite sides of the gripper housing when the jaw means are in an open position and the free and attached ends of the second jaw means being on opposite sides of the gripper housing when the jaw means are in the open position, and, the hydraulic cylinder connecting the gripper housing to one of the jaw means and a jaw linkage member being pivotally attached to both of the jaw means, whereby movement of the hydraulic cylinder results in movement of both of the jaw means.

12. The automated container loader according to claim 11, wherein each jaw means comprises a flexible belt having one end attached to the free end and another end attached to the gripper housing, each belt located inward of the respective jaw means and tensioned to engage the refuse container.

13. The automated container loader according to claim 12, wherein the first jaw means comprises a single jaw member and a flexible belt and the second jaw means comprises a pair of substantially parallel jaw members and flexible belts in spaced apart vertical relation to each other to allow the single jaw member to pass between the parallel jaw members.

14. The automated container loader according to claim 13, wherein each of the flexible belts engages against the refuse container to thereby secure the refuse container between the belts when the first and second jaw means grip the refuse container.

* * * * *